US010433053B2

(12) United States Patent
Kim

(10) Patent No.: US 10,433,053 B2
(45) Date of Patent: Oct. 1, 2019

(54) MICRO SPEAKER DEVICE WITH WATER-PROOF STRUCTURE

(71) Applicant: BUJEON CO., LTD., Ansan-si (KR)

(72) Inventor: Minkyeom Kim, Yangju-si (KR)

(73) Assignee: BUJEON CO., LTD., Ansan-si (KR)

( * ) Notice: Subject to any disclaimer, the term of this patent is extended or adjusted under 35 U.S.C. 154(b) by 20 days.

(21) Appl. No.: 16/198,450

(22) Filed: Nov. 21, 2018

(65) Prior Publication Data

US 2019/0182586 A1 Jun. 13, 2019

(30) Foreign Application Priority Data

Sep. 21, 2017 (KR) ..... 10-2017-0121849

(51) Int. Cl.

| | |
|---|---|
| ***H04R 1/44*** | (2006.01) |
| ***H04R 1/02*** | (2006.01) |
| ***H04R 7/12*** | (2006.01) |
| ***H04R 7/16*** | (2006.01) |
| ***H04R 9/06*** | (2006.01) |
| ***H04R 9/02*** | (2006.01) |

(52) U.S. Cl.

CPC ..... *H04R 1/44* (2013.01); *H04R 1/025* (2013.01); *H04R 7/12* (2013.01); *H04R 7/16* (2013.01); *H04R 9/025* (2013.01); *H04R 9/06* (2013.01)

(58) Field of Classification Search

CPC . H04R 1/44; H04R 1/025; H04R 9/06; H04R 9/025; H04R 7/12; H04R 7/16

See application file for complete search history.

(56) References Cited

U.S. PATENT DOCUMENTS

2016/0241938 A1* 8/2016 Huang ..... H04R 1/023

FOREIGN PATENT DOCUMENTS

| | | | |
|---|---|---|---|
| JP | 2012-044605 | A | 3/2012 |
| KR | 10-2007-0090694 | A | 9/2007 |
| KR | 10-2015-0100316 | A | 9/2015 |
| KR | 10-1760428 | B1 | 7/2017 |

* cited by examiner

*Primary Examiner* — Ping Lee

(74) *Attorney, Agent, or Firm* — KORUS Patent, LLC; Seong Il Jeong

(57) ABSTRACT

The present disclosure provides a micro speaker device with a water-proof structure by which water entering a protector is prevented from entering a gap formed between a top face of the protector and a bottom face of an upper plate of an outer casing and a gap formed between a bottom face of the protector and a top face of an outer peripheral portion of a vibration plate. For this end, the protector includes: an upper portion extending upward so as to be in close contact with a bottom face of the upper plate of the outer casing; and a lower portion, wherein the lower portion includes: a sealing member made of a rubber material, wherein the sealing member extends downward to closely contact a top face of the outer peripheral portion of the vibration plate; and a support member made of a plastic material, wherein the support member closely contacts a side face of the sealing member to support the sealing member.

6 Claims, 5 Drawing Sheets

MICRO SPEAKER DEVICE WITH WATER-PROOF STRUCTURE

CROSS-REFERENCE TO RELATED APPLICATION(S)

This application is based on and claims priority under 35 U.S.C. § 119 to Korean Patent Application No. 10-2017-0121849, filed on Sep. 21, 2017, in the Korean Intellectual Property Office, the disclosure of which is incorporated by reference herein its entirety.

BACKGROUND

1. Field

The present disclosure relates to a micro speaker device, and, more particularly, to a micro speaker device with a water-proof structure having a sealing member by which water entering a protector is prevented from entering a gap formed between a top face of the protector and a bottom face of an upper plate of an outer casing and a gap formed between a bottom face of the protector and a top face of an outer peripheral portion of a vibration plate.

2. Description of Related Art

Speaker manufacturers are constantly working to reduce a size of speakers used in miniaturized devices such as headphones, hearing aids, and cellular phones. U.S. Pat. No. 5,243,662 (1993, Sogn, et al) discloses an example of such a micro speaker device. In this patent document, a miniaturized electrodynamic sound generator with a permanent magnet having a vibration plate, a magnet yoke, and a voice coil is disclosed. With these efforts, the micro speaker used in smart phones and the like recently has a diameter of several centimeters.

Recently, a micro speaker device that is smaller than a conventional micro speaker has been required for development of a semiconductor technology, a beautiful design implementation, or for a specific purpose. Because these micro speaker devices are only a few millimeters in diameter, there occurs following defects: a decrease in acoustic efficiency due to a reduction in effective vibration area, a decrease in magnetic flux density due to a reduction in magnetic circuit, and a defect in manufacture due to size reduction.

For example, a micro speaker device includes a magnetic assembly composed of a top plate, a magnet and a yoke, and a voice coil installed in a gap of the magnetic assembly, a vibration plate fixed to an upper end of the voice coil, a protector provided on the vibration plate, and an outer casing to house the assembly, voice coil, vibration plate and protector.

FIG. 5 is a cross-sectional view of a conventional micro speaker device. As shown, a conventional micro speaker device includes a magnetic assembly composed of a top plate, a magnet, and a yoke; a voice coil installed in a gap between the top plate and the yoke; a vibration plate attached to a top face of the voice coil and having an outer peripheral portion fixed to a top face of the top plate; a cylindrical protector installed on the vibration plate and having a sound discharge hole formed therein, wherein the protector is constructed for fixing an outer peripheral portion of the vibration plate; a cylindrical outer casing for housing the magnetic assembly, the vibration plate and the protector therein, wherein the outer casing has an upper plate having a sound discharge hole defined therein and has an open bottom; and a printed circuit board mounted below the yoke and fixedly attached to an inner face of the outer casing. Further, on an outer face of the magnetic assembly composed of the top plate, the magnet and the yoke, an inner casing closely attached to the inner face of the outer casing is further installed.

The protector has a sound discharge hole for discharging sound generated from the vibration plate to the outside. The protector includes an upper ring member which is in close contact with a top face of the outer casing, and a lower ring member integrally formed below the upper ring member and pressing the outer peripheral portion of the vibration plate. In the upper ring member and the lower ring member, a dome shaped portion is present such that sound generated from the vibration plate is smoothly discharged to the outside through the emission hole and sound emission formed in the top face of the outer casing.

However, in the micro speaker device according to the prior art, since the protector is made of a plastic material, the water introduced into the protector through the sound discharge hole of the outer casing and the sound discharge hole of the protector passes through a gap formed between the upper ring member of the protector and the upper plate of the outer casing and a gap formed between the lower ring member and the outer peripheral portion of the vibration plate and then is introduced into the vibration plate. This may adversely affect the magnetic assembly. Further, there was a problem that the water introduced into the magnetic assembly flows into the inner part of the device through the gap between the outer casing and the inner casing, thereby adversely affecting the device.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

One purpose of the present disclosure is to provide a water-proof structure for a micro speaker device that prevents water flowing into the protector from passing through the vibration plate and affecting the magnetic assembly.

Further, another purpose of the present disclosure is to provide a water-proof structure for a micro speaker device that prevents water entering a lower portion of the vibration plate from flowing into the magnetic assembly through a lower end of the outer casing.

In one aspect of the present disclosure, there is provided a micro speaker device having a water-proof structure, the device comprising: a magnetic assembly composed of a top plate, a magnet, and a yoke; a voice coil installed in a gap between the top plate and yoke; a vibration plate attached to a top face of the voice coil and having an outer peripheral portion fixed to a top face of the top plate; a cylindrical protector installed on the vibration plate and having a sound discharge hole formed therein, wherein the protector is constructed for fixing an outer peripheral portion of the vibration plate; and a cylindrical outer casing for housing the magnetic assembly, the vibration plate and the protector therein, wherein the outer casing has an upper plate having a sound discharge hole defined therein and has an open bottom, wherein the protector includes: an upper portion extending upward so as to be in close contact with a bottom face of the upper plate of the outer casing; and a lower portion, wherein the lower portion includes: a sealing member made of a rubber material, wherein the sealing member extends downward to closely contact a top face of the outer peripheral portion of the vibration plate; and a support member made of a plastic material, wherein the support member closely contacts a side face of the sealing member to support the sealing member.

In one embodiment, the device further comprises an inner casing receiving the magnetic assembly, wherein the inner casing closely contacts an inner face of the outer casing.

In one embodiment, the yoke includes a hollow cylinder extending vertically and having a hollow portion, and a support disc integrally formed at a lower end of the hollow cylinder, wherein the magnet is spaced by a predetermined distance from the hollow cylinder of the yoke, wherein the top plate has a ring shape mounted on a top face of the magnet, wherein each of outer side face portions of the top plate and the magnet has a first cut-out, wherein a groove is formed in an outer side face portion of the support disc of the yoke, wherein a second cut-out is formed in one side portion of the inner casing, wherein a lead wire of the voice coil is connected through the first cut-out, groove, and second cut-out to a printed circuit board installed on a bottom face of the yoke.

In one embodiment, the outer casing includes an inwardly bent portion formed by bending a lower end of the outer casing inwardly such that the inwardly bent portion is in close contact with a lower end of the inner casing.

In one embodiment, the support member includes an inner support member mounted on an inner side face of the sealing member and an outer support member mounted on an outer side face of the sealing member, wherein a step is formed at a vertical middle level of the sealing member, wherein a receiving groove for receiving the step is formed in an inner lower end of the outer support member, wherein an inclined curved face is formed on an inner lower end of the inner support member so as to correspond to an inner face of the sealing member.

According to the present disclosure, the top face of the sealing member provided on the protector is in close contact with the bottom face of the upper plate of the outer casing. Thus, it is possible to prevent the inflow of water through the gap between the top face of the protector and the upper plate of the outer casing.

Further, according to the present disclosure, the bottom face of the sealing member provided on the protector is brought into close contact with the top face of the outer peripheral portion of the vibration plate. Thus, it is possible to prevent the inflow of water through the gap between the bottom face of the protector and the outer peripheral portion of the vibration plate.

Further, in accordance with the present disclosure, the inwardly bent portion formed by bending the lower end of the outer casing inwardly can block the inflow of water through the gap between the inner casing and the outer casing.

Further, according to the present disclosure, there is further provided the inner casing surrounding the magnetic assembly having the top plate, magnet, and yoke. When, for adhesion between the top plate and the magnet, an adhesive bond is applied between the bottom face of the top plate and the bottom face of the magnet, the adhesive bond is prevented from flowing down to the outer side face. This facilitates assembly between the magnetic assembly and outer casing.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTIONS

Figure 1:
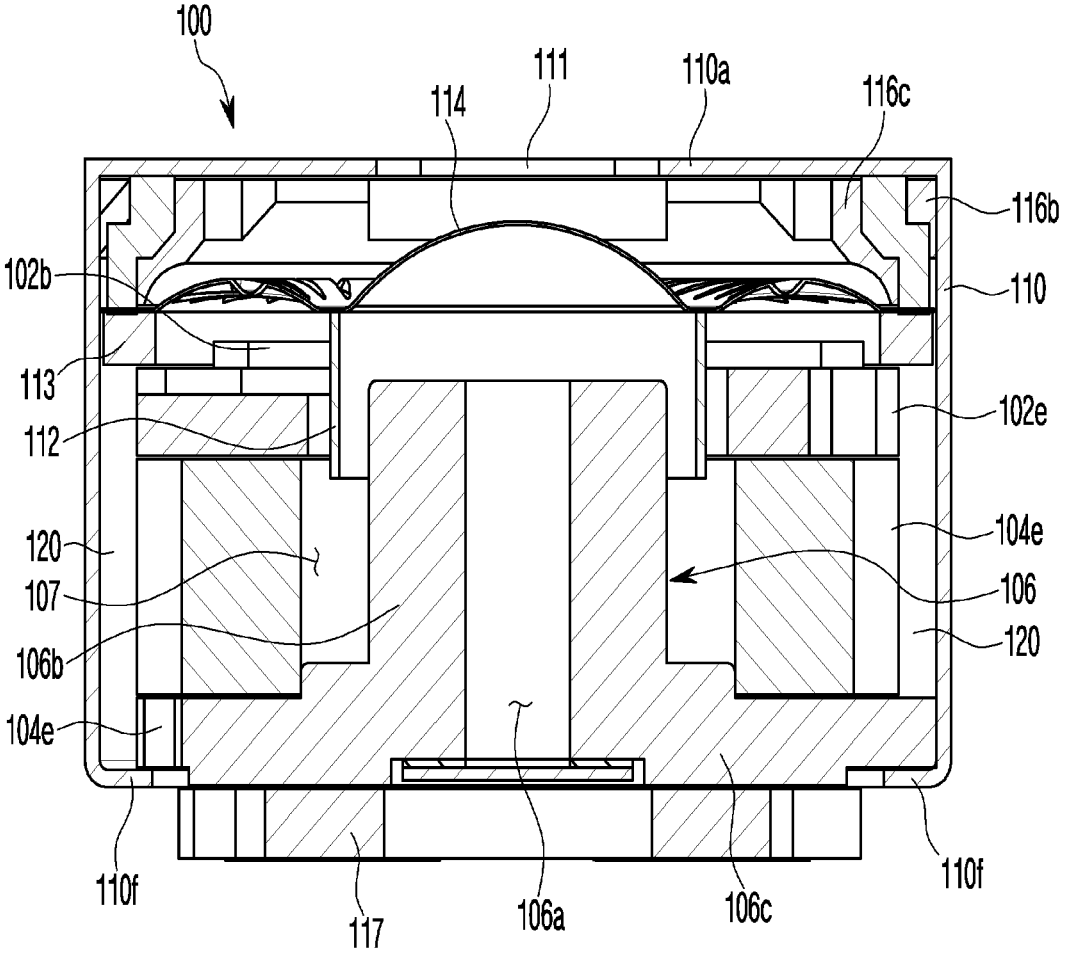
FIG. 1 is a cross-sectional view showing an example of a micro speaker device equipped with a water-proof structure according to the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Figure 2:
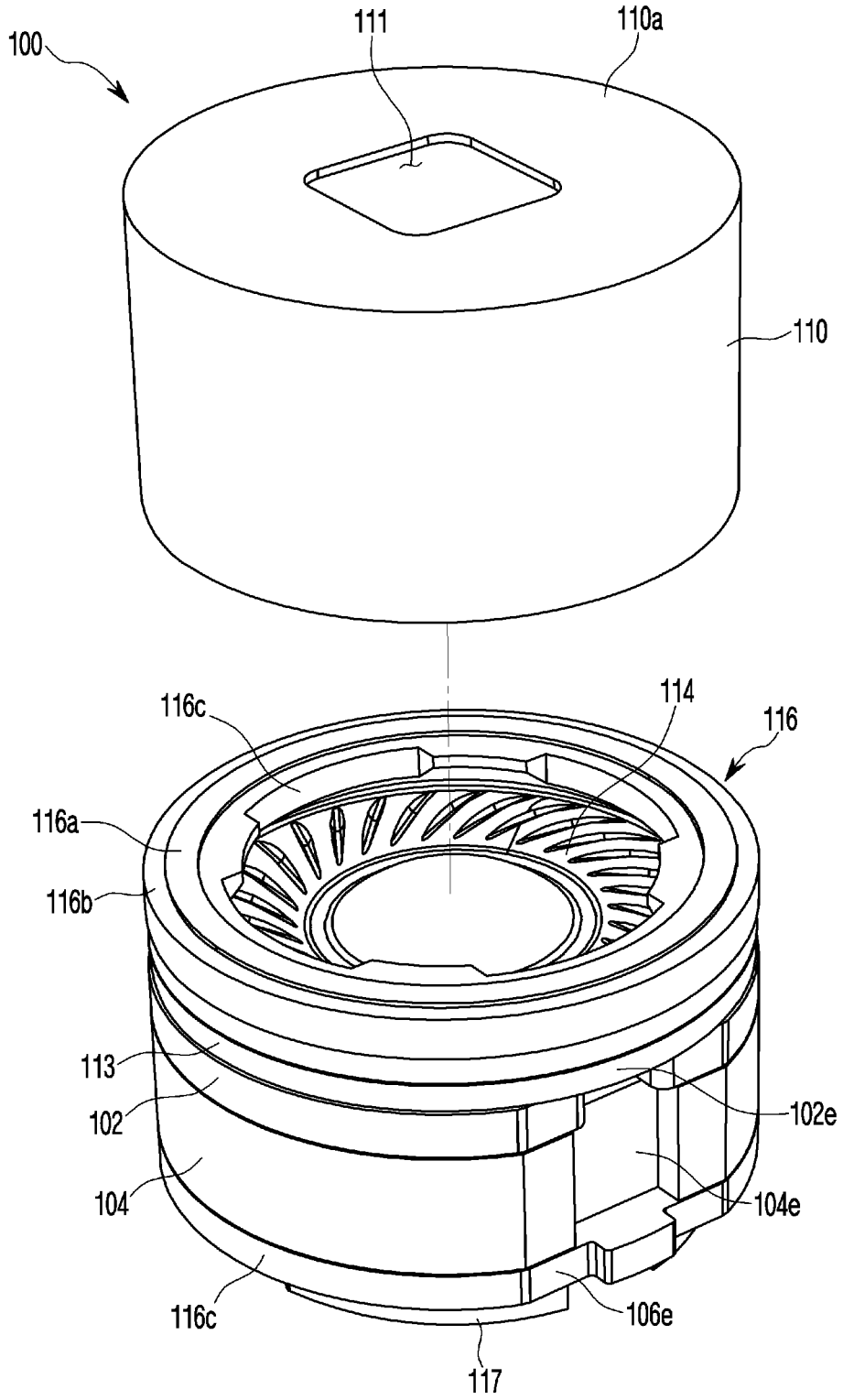
FIG. 2 is an exploded perspective view showing a state in which an outer casing is separated from a micro speaker device equipped with a water-proof structure according to the present disclosure.
Figure 3:
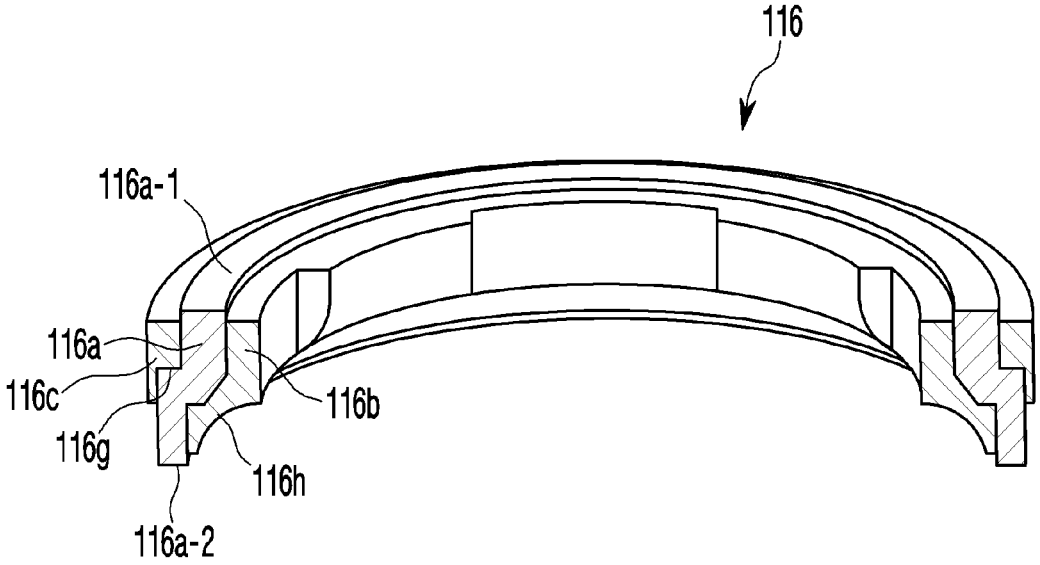
FIG. 3 is an isometric view showing an example of a protector according to the present disclosure.
Figure 4:
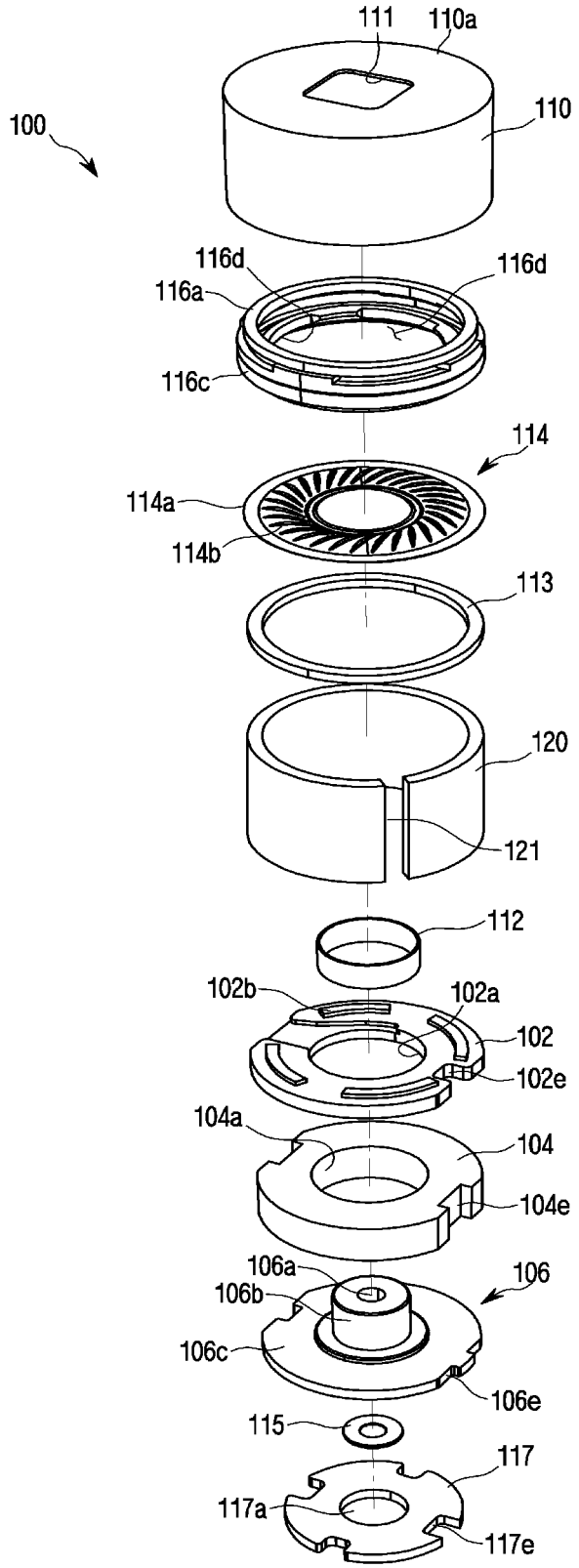
FIG. 4 is an exploded perspective view of a micro speaker device equipped with a water-proof structure according to the present disclosure.
Figure 5:
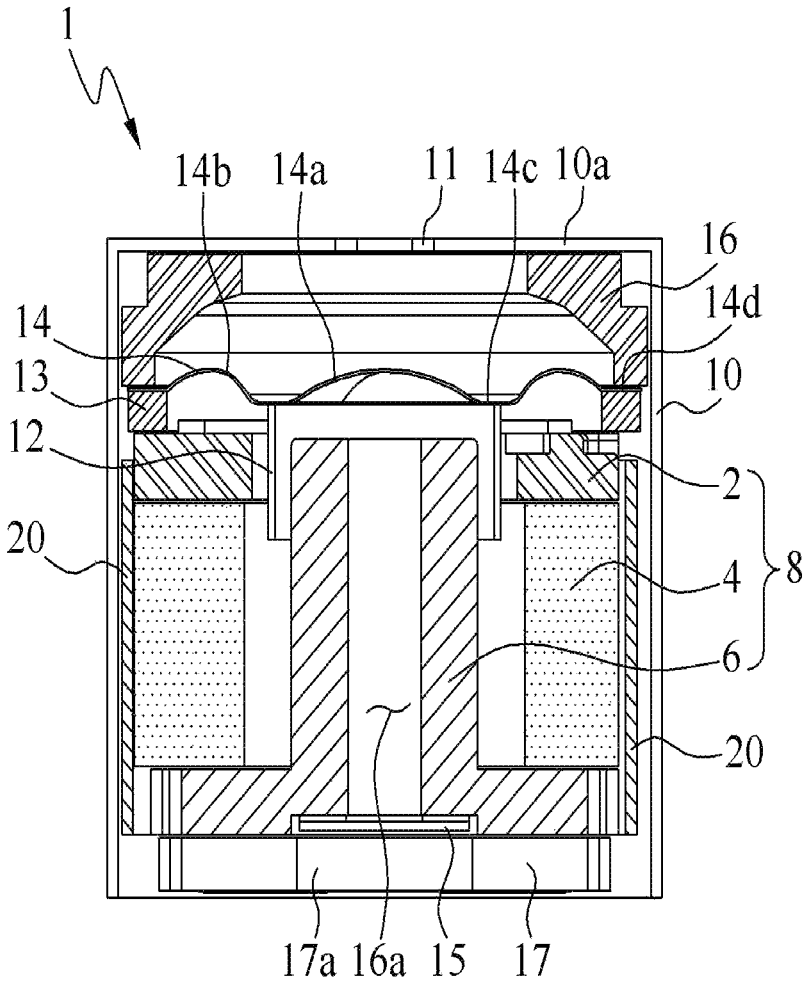
FIG. 5 is a cross-sectional view showing an internal structure of a micro speaker device according to the prior art.

FIG. 1 is a cross-sectional view showing an example of a micro speaker device equipped with a water-proof structure according to the present disclosure. FIG. 2 is an exploded perspective view showing a state in which an outer casing is separated from a micro speaker device equipped with a water-proof structure according to the present disclosure. FIG. 3 is an isometric view showing an example of a protector according to the present disclosure. FIG. 4 is an exploded perspective view of a micro speaker device equipped with a water-proof structure according to the present disclosure. FIG. 5 is a cross-sectional view showing an internal structure of a micro speaker device according to the prior art.

As shown, a micro speaker device 100 equipped with a water-proof structure according to the present disclosure includes a magnetic assembly 118 composed of a top plate, a magnet, and a yoke; a voice coil 112 installed in a gap between the top plate and yoke; a vibration plate 114 attached to a top face of the voice coil and having an outer peripheral portion fixed to a top face of the top plate; a cylindrical protector 116 installed on the vibration plate and having a sound discharge hole 111 formed therein and fixing an outer peripheral portion of the vibration plate; a cylindrical inner casing 120 mounted on an outer face of the magnetic assembly; a cylindrical outer casing 110 housing the inner casing 120, the vibration plate 113 and the protector 116 and having an upper plate 110*a* integrally formed therewith, wherein the upper plate has the sound discharge hole 111 formed therein; and a printed circuit board 117 installed below the yoke.

A first aspect of the water-proof structure of the micro speaker device according to the present disclosure may be achieved by the protector 116 installed between the bottom face of the upper plate 110*a* of the outer casing 110 and the outer peripheral portion 114*a* of the vibration plate 114.

For this purpose, the protector 114 is formed in a cylindrical shape made of a rubber material. An upper portion of the protector extends upward so as to be in close contact with the bottom face of the upper plate 110*a* of the outer casing 110. A lower portion of the protector includes a sealing member 116*a* extending downward to closely contact the top face of the outer peripheral portion 114*a* of the vibration plate 114, and support members 116*c* and 116*d* made of a plastic material adhered to a side face of the sealing member 116*a* to support the sealing member 116*a*.

The magnetic assembly 118 includes a yoke 106 vertically installed in a center thereof, a magnet 104 spaced a predetermined distance from the outer circumference of the yoke 106, and a top plate 102 installed on the top face of the magnet 104.

Further, the inner casing 120 installed between the magnetic assembly 118 and the outer casing 110 allows the magnetic assembly 118 to be easily assembled to the outer casing 110. The inner casing 120 receives the magnetic assembly 118 consisting of the yoke 106, the magnet 104 and the top plate 102. In particular, when applying the adhesive bond on the bottom face of the top plate 102 and the top face of the magnet 104, the inner casing serves to prevent the adhesive bond from flowing to the outer side face.

Further, a second aspect of the water-proof structure of the micro speaker device according to the present disclosure may be achieved by an inwardly bent portion 110*f* formed by bending the lower end of the outer casing 110 inwardly. That is, the inwardly bent portion 110*f* is formed by bending the lower end of the outer casing 110 inwardly to be in close contact with the lower end of the inner casing 120. Accordingly, the inflow of water into the speaker device through the gap between the outer casing 110 and the inner casing 120 can be blocked.

More specifically, the outer casing 110 is integrally formed with the upper plate 110*a* having one or more sound discharge holes 111 in the center thereof. The lower portion of the outer casing is formed in an open cylindrical shape. The outer casing 110 is configured to accommodate the inner casing 120, the fixing ring 113, the vibration plate 114, and the protector 116 therein.

In addition, the magnetic assembly 118 is received in the inner casing 120. The inner casing 120 is formed of a cylinder closely attached to the inner face of the outer casing 110. The upper end and the lower end of the inner casing 120 are opened. A cut-out 121 is formed in one side face of the inner casing.

The magnetic assembly 118 includes the yoke 106 having a hollow cylinder 106*b* having a hollow portion 106*a* and vertically installed and a support disc 106*c* integrally formed at a lower end thereof an annular magnet 104 spaced a certain distance from the hollow cylinder 106*c* and supported by the top face of the support disc 106*c*; and a ring-shaped top plate 102 provided on the top face of the magnet 104.

In addition, cut-outs 102*e* and 104*e* are formed in the outer side face portions of the magnet 104 and the top plate 102, respectively. At least one groove 106*e* is formed in the side face portion of the support disc 106*c* of the yoke 106. The cut-outs 102*e* 104*e* and groove 106*e* guide the lead wires of the voice coil 112.

The vibration plate 114 is mounted on the magnetic assembly 118. The vibration plate 114 includes an inner dome 114*c* formed in the center thereof and an outer dome 141*b* in an outer portion thereof. In addition, a coil adhering portion 114*d* to which the voice coil 112 is attached is formed between the inner dome 114*c* and the outer dome 114*b*. An outer peripheral portion 114*a* having a flat surface is formed on an outer edge of the outer dome 114*b*.

Thus, the voice coil 112 attached to the bottom face of the coil adhering portion 114*d* is located within the gap 107 of the magnetic assembly 118. The outer peripheral portion 114*a* is fixed to the top face of the fixing ring 113 provided on the outer face of the top face of the top plate 102. Further, on the top face of the top plate 102, a plurality of protrusions 102*b* are formed. A guide groove for guiding the lead wire of the voice coil 112 is formed between the protrusions 102*b*.

Furthermore, the protector 116 is installed on the vibration plate 114. The protector 116 is composed of the sealing member 116*a* and support members 116*c* and 116*d* as shown in FIG. 3. In addition, the sound discharge hole 116*d* is formed in the central area of the protector 116 so that sound generated from the vibration plate 114 can be emitted to the outside. The sealing member 116*a* is made of a rubber material so as to have a waterproof function. The support member 116*a* is made of a plastic material to support the sealing member 116*a*.

Preferably, the sealing member 116*a* is made of a cylinder having a top face 116*a*-1 and a bottom face 116*a*-2. A step 116*g* protruding outward from the center of the sealing member is formed. In addition, the top face 116*a*-1 of the sealing member 116*a* protrudes upward by a predetermined length so as to be in close contact with the bottom face of the upper plate 110*a* of the outer casing 110. The bottom face 116*a*-2 extends downward and is protruded by a predetermined length so as to be in close contact with the top face of the outer peripheral portion 112*a* of the vibration plate 112.

In addition, the support members 116*b* and 116*c* include an inner support member 116*b* mounted on the inner side face of the sealing member 116*a* and an outer support member 116*c* installed on the outer side face of the sealing member 116*a*. Preferably, a receiving groove for receiving the step 116*g* formed in the center of the sealing member 116*a* is formed at an inner lower end of the outer support member 116*c*. Therefore, the outer support member 116*c* may be firmly fixed to the sealing member since the member 116*c* is coupled to the sealing member in a manner engaged with the step 116*g*.

In addition, an inclined curved face 116*h* is formed on the inner lower end of the inner support member 116*b* so as to correspond to the inner surface of the sealing member 116*a*. The inclined curved face 116*h* is formed corresponding to the curved surface of the outer dome 116*b* of the vibration plate 114. As a result, when the vibration plate 114 vibrates up and down, collision therebetween does not occur. Further, the inclined curved face 116*h* guides the sound generated from the vibration plate 114 to be smoothly discharged to the outside through the sound discharge hole 116*d*. Preferably, the sealing member 116*a* according to the present embodiment may be integrally formed via insert injection molding when the inner support member 116*b* and the outer support member 116*c* are injection molded.

Further, on the bottom face of the support disc 106*c* of the yoke 106, the printed circuit board 117 is installed. The printed circuit board 117 has a disk shape. A through-hole 117*a* is formed in the center of the board to communicate with the hollow portion 106*a* formed in the hollow cylinder 106*b* of the yoke 106. A plurality of grooves 117*e* are formed around the center of the board. The lead wire of the voice coil passes through the grooves 117*e*.

In addition, the inwardly bent portion 110*f* is formed at the lower end of the outer casing 110. The inwardly bent portion 110*f* is formed by bending the lower end of the outer casing 110 to the inner side and coming into close contact with the lower end of the inner casing 120. Therefore, water can be prevented from flowing into the speaker device through the gap between the outer casing 110 and the inner casing 120.

Hereinafter, a method of assembling a micro speaker device 100 provided with a water-proof structure according to the present disclosure will be described.

First, into the inner casing 120, the yoke 106, the magnet 104, and the top plate 102 of the magnetic assembly 118 are sequentially installed. The inner casing 120 blocks the adhesive bond applied to the bottom face of the top plate 102 and the top face of the magnet 104 from flowing to the outer side face. This facilitates subsequent assembly of the outer casing 110.

Next, the protector 116, the vibration plate 114, and the fixing ring 113 are sequentially installed through the opened lower portion of the outer casing 110. Thus, the top face of the sealing member 116*a* of the protector 116 is in close contact with the bottom face of the upper plate 110*a* of the outer casing 110. In addition, the lower end of the sealing member 116*a* of the protector 116 is in close contact with the top face of the outer peripheral portion 114*a* of the vibration plate 114. Accordingly, the water introduced into the protector 116 is prevented from flowing into the gap between the top face of the protector 116 and the upper plate of the outer casing 110. Further, water may be blocked from flowing into the gap between the bottom face of the protector 116 and the outer peripheral portion 114*a* of the vibration plate 114.

In this regard, an adhesive bond may be applied on the bottom face of the protector 116 and the top face of the fixing ring 113 for fixing the outer peripheral portion 114*a* of the vibration plate 114. In this regard, the voice coil 112 is attached to the bottom face of the voice coil adhering portion 114*d* of the vibration plate 114. Then, the inner casing 120 in which the magnetic assembly 118 is assembled is inserted into the outer casing 110. Then, the voice coil 112 attached to the vibration plate 114 is positioned within the gap 107 between the yoke 106 and the magnet 104.

In one embodiment, the lead lines 112*a* and 112*b*, which are connected to both ends of the voice coil 112 may pass through the cut-out 121 formed in the inner casing 120 and the cut-outs 102*e* and 104*e* formed in the side face portions of the top plate 102 and magnet 104 and then, the groove 106*e* formed in the side face portion of the support disc 106*c* of the yoke 106 and then the grooves 117*e* formed in the edge of the printed circuit board 117 and finally is connected to a connection terminal (not shown) formed on the printed circuit board 117.

In the micro speaker device 100 having a waterproof function according to the present disclosure, the protector 116 having the sealing member 116*a* is installed between the bottom face of the upper plate 110*a* of the outer casing 110 and the outer peripheral portion 114*a* of the vibration plate 114. As a result, the entry of water into the device from outside can be blocked.

Further, according to the present disclosure, the magnetic assembly 118 composed of the yoke 106, the magnet 104, and the top plate 102 is installed inside the inner casing 120. Then, the inner casing is inserted into the outer casing 110. This facilitates assembly of the present device.

Further, according to the present disclosure, the lead wires 112*a* and 112*b* of the voice coil 112 can be easily drawn out through the cut-out 121 formed in the inner casing 120 and the cut-outs 102*e* and 104*e* formed in the top plate 102 and the magnet 104 and the groove 106*e* formed in the support disc 106*c* of the yoke 106, and the groove 117*e* formed in the printed circuit board 117.

Further, according to the present disclosure, the inwardly bent portion 116*f* formed by bending the lower end of the outer casing 110 inwardly can block water from flowing into the gap between the inner casing 120 and the outer casing 110.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A micro speaker device having a water-proof structure, the device comprising:

a magnetic assembly composed of a top plate, a magnet, and a yoke;

a voice coil installed in a gap between the top plate and yoke;

a vibration plate attached to a top face of the voice coil and having an outer peripheral portion fixed to a top face of the top plate;

a cylindrical protector installed on the vibration plate and having a sound discharge hole formed therein, wherein the protector is constructed for fixing an outer peripheral portion of the vibration plate; and a cylindrical outer casing for housing the magnetic assembly, the vibration plate and the protector therein, wherein the outer casing has an upper plate having a sound discharge hole defined therein and has an open bottom, wherein the protector includes:

an upper portion extending upward so as to be in close contact with a bottom face of the upper plate of the outer casing; and a lower portion, wherein the lower portion includes:

a sealing member made of a rubber material, wherein the sealing member extends downward to closely contact a top face of the outer peripheral portion of the vibration plate; and a support member made of a plastic material, wherein the support member closely contacts a side face of the sealing member to support the sealing member, wherein the support member includes an inner support member mounted on an inner side face of the sealing member and an outer support member mounted on an outer side face of the sealing member, wherein a step is formed at a vertical middle level of the sealing member, wherein a receiving groove for receiving the step is formed in an inner lower end of the outer support member, wherein an inclined curved face is formed on an inner lower end of the inner support member so as to correspond to an inner face of the sealing member, and wherein the inclined curved face is formed to conform to a curved surface of an outer dome of the vibration plate, such that when the vibration plate vibrates up and down, collision therebetween does not occur.

2. The micro speaker device of claim 1, wherein the device further comprises an inner casing receiving the magnetic assembly, wherein the inner casing closely contacts an inner face of the outer casing.

3. The micro speaker device of claim 2, wherein the yoke includes a hollow cylinder extending vertically and having a hollow portion, and a support disc integrally formed at a lower end of the hollow cylinder, wherein the magnet is spaced by a predetermined distance from the hollow cylinder of the yoke, wherein the top plate has a ring shape mounted on a top face of the magnet, wherein each of outer side face portions of the top plate and the magnet has a first cut-out, wherein a groove is formed in an outer side face portion of the support disc of the yoke, wherein a second cut-out is formed in one side portion of the inner casing, wherein a lead wire of the voice coil is connected through the first cut-out, groove, and second cut-out to a printed circuit board installed on a bottom face of the yoke.

4. The micro speaker device of claim 3, wherein the outer casing includes an inwardly bent portion formed by bending a lower end of the outer casing inwardly such that the inwardly bent portion is in close contact with a lower end of the inner casing.

5. The micro speaker device of claim 4, wherein the support member includes an inner support member mounted on an inner side face of the sealing member and an outer support member mounted on an outer side face of the sealing member, wherein a step is formed at a vertical middle level of the sealing member, wherein a receiving groove for receiving the step is formed in an inner lower end of the outer support member, wherein an inclined curved face is formed on an inner lower end of the inner support member so as to correspond to an inner face of the sealing member.

6. The micro speaker device of claim 2, wherein the outer casing includes an inwardly bent portion formed by bending a lower end of the outer casing inwardly such that the inwardly bent portion is in close contact with a lower end of the inner casing.

* * * * *